United States Patent [19]

Gogniat

[11] Patent Number: 4,473,305

[45] Date of Patent: Sep. 25, 1984

[54] WATCHCASE HAVING RESILIENT SNAP-FIT FOR RIGID CRYSTAL

[75] Inventor: Paul Gogniat, Bienne, Switzerland

[73] Assignee: Montres Rado S.A., Longeau, Switzerland

[21] Appl. No.: 379,514

[22] Filed: May 18, 1982

[30] Foreign Application Priority Data

Jun. 1, 1981 [CH] Switzerland ..... 3556/81

[51] Int. Cl.[3] ..... G04B 37/00

[52] U.S. Cl. ..... 368/294; 368/295; 368/291; 368/292

[58] Field of Search ..... 368/291–296, 368/276, 286; 29/177, 179

[56] References Cited

U.S. PATENT DOCUMENTS

| | | | |
|---|---|---|---|
| 2,029,769 | 2/1936 | Goldblatt | 368/294 |
| 3,292,362 | 12/1966 | Klingenberg | 368/295 |
| 4,308,611 | 12/1981 | Kanai | 368/294 |

FOREIGN PATENT DOCUMENTS

| | | | |
|---|---|---|---|
| 2251044 | 11/1978 | France | 368/294 |
| 75169 | 2/1917 | Switzerland | 368/294 |
| 353686 | 5/1961 | Switzerland | 368/276 |

*Primary Examiner*—Bernard Roskoski
*Attorney, Agent, or Firm*—Peter L. Berger

[57] ABSTRACT

A watchcase (1) comprises a flat crystal (3) of hard material held by pressure between elastically deformable opposite side walls (4) of a recess (5) formed at the top of the body (2) of the watchcase. The bottom face (8) of the crystal (3) compresses a seal (9) arranged around the opening of the body. The restoring force exerted on the bevel of the crystal by the facing surface of the walls (4) as well as the rigidity of the crystal make it possible to make tightly sealed watchcases in which the crystal is held on the body over a portion of its margins only.

4 Claims, 4 Drawing Figures

WATCHCASE HAVING RESILIENT SNAP-FIT FOR RIGID CRYSTAL

BACKGROUND AND SUMMARY OF THE INVENTION

The present invention relates to the mounting of a flat crystal made of hard material, sapphire type for example, at the top of the body of a watch case.

The use of crystals of hard material is becoming increasingly widespread at the present time for fine watchcases, not only because of their excellent abrasion resistance but also because they will permit structures of smaller thickness due to their rigidity.

Accordingly, many methods have already been proposed for mounting such crystals in the opening of a case body or bezel. One is cementing which will not permit ready replacement of the crystal and will not always provide a good seal over space time. Another method is setting the crystal in a recess with interposition of a sealing strip which has the disadvantages of requiring a recess sufficiently high to retain the crystal by friction and extending around the entire perimeter of the body, which limits the ability of making the case out of precious material.

There are also other designs in which a flat crystal of hard material is inserted laterally in tracks provided on opposite sides of the body. It is then possible to make cases of very special styling in which the crystal extends to the edge of the body on its other two sides, but the engagement of the crystal in the tracks may cause damage to the sealing strip. In addition, the requirement of tracks limits the possible shapes of the case.

Accordingly, the invention comprises a watch case fitted with a flat crystal of hard material, in which the means of mounting the crystal on the body, or possibly in a bezel, do not have the above-mentioned disadvantages, and the crystal may be readily attached and removed without danger of displacing or damaging the seal. The present invention provides new possibilities in terms of shape and styling of the case.

The objects are achieved by providing means to engage the crystal under pressure between the elastically deformable side walls of a recess made in the body, the facing surfaces of said side walls and of the edge of the crystal being inclined relative to the axis of the case.

Of course, the recessed mounting of a crystal on a body is known per se, but not the recessed mounting of a flat crystal of hard material. For example, Swiss patent application No. 17,027/66 or French Pat. No. 1,398,410 and 2,395,536 describe watchcases in which the crystal is provided with an annular skirt or border elastically deformable so as to lock against matching surfaces provided on the edges of the body opening. But this arrangement is limited to a flat, rigid crystal having an annular skirt on the body. One of the important features of this invention is to provide a recess over only a portion of the periphery of the crystal without impairing the seal of the assembly by using the intrinsic elasticity of the material of which the body is made to supplement the rigidity of the crystal and ensure a proper retention of the crystal. The restoring force exerted by the side walls of the recess on the edge of the crystal in conjunction with the rigidity of the crystal does serve to ensure perfect application of the bottom face of the crystal to a sealing strip throughout the perimeter of the latter, even if only locally retained in the recess.

BRIEF DESCRIPTION OF THE DRAWING

The invention may be understood from a reading of the following description given with reference to the accompanying drawings, in which.

DETAILED DESCRIPTION

Figure 1:
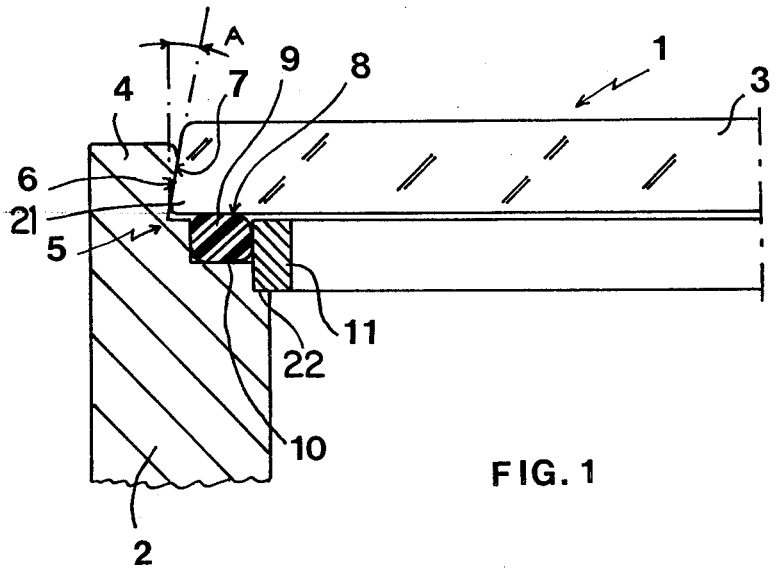
FIG. 1 is a schematic view in partial section of a watchcase according to the invention, and FIGS. 2 to 4 respectively represent, in top view, three different watchcases incorporating the invention.

As seen in FIG. 1, the watchcase 1 comprises a body 2 to the top of which is fixed a crystal 3. The crystal 3 is flat and is made of hard material, such as sapphire, while the body 2 is of a common metal, such as steel or brass. The crystal 3 is pressure-mounted between opposite side walls 4 of a recess 5 formed in body 2, these walls being capable of a slight elastic deformation because of the thinness of the walls. The facing surfaces 6 of the side walls 4 and edge 7 of the crystal 3 are inclined relative to the axis of the case 1 at an angle A of between 4 and 10 degrees approximately, preferably between 5 and 8.5 degrees. The top of the crystal 3 projects above the top of body 2 and the bottom corner 21 of crystal 3 fits in the angled recessed corner formed in the body 2 to provide a stepped recessed portion on which the outer bottom edge of crystal 3 rests. A further recess or shoulder 10 is formed in said stepped recessed portion in which a sealing strip 9 is placed. The upper portion of sealing strip 9 bears against a bottom outer margin of bottom face 8. A ring 11 bears against the inner side surface of sealing strip 9 to hold the strip in place. The ring fits in a corresponding inward recess 22 formed as a step down from recess or shoulder 10. The seal 9 and ring 11 may be masked by a thin metalizing layer deposited on the matching portions of the bottom face 8 of the crystal 3. The crystal is easily removed by exerting a thrust towards the outside of the case on the bottom face 8.

Figure 2:
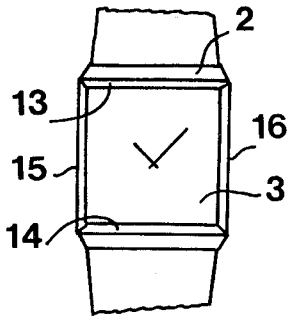

FIG. 2 shows a watch case according to the invention in which the crystal 3 is held in the recess of the case 2 on only two of its straight sides, these two holding sides 13 and 14 being opposite to each other. The other two sides 15, 16 extend all the way to the edge of the body.

Figure 3:
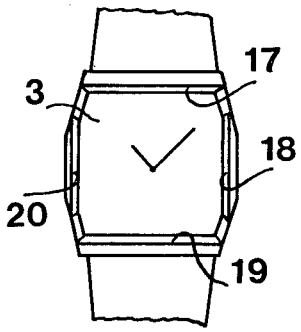
Figure 4:
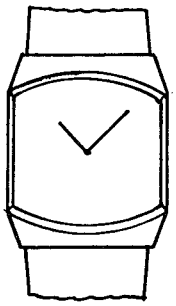

FIG. 3 shows an alternate watchcase in which the crystal is retained along two pairs of opposite line portions 17, and 19 and 18 and 20, respectively of the body separated by portions where the crystal extends to the edge of the body. FIG. 4 shows another watchcase in which the facing surfaces of the side walls 23 and 24 of the recess which hold the crystal and the edge of the crystal have a curvilinear profile.

Although it has been described in terms of certain embodiments only, the invention is capable of numerous modifications and variants that will suggest themselves to one skilled in the art.

What is claimed is:

1. A watchcase comprising a body and a flat crystal made of a rigid material, said body having a recess formed in the top thereof forming a seating surface, said recess being formed by opposite side walls, said opposite side walls being resilient and having opposite facing surfaces, said crystal being attached to said body in said recess on said seating surface and being held against said opposite side walls, the facing surfaces of said side walls and the edges of the crystal being inclined relative to the axis of the case, said recess of said body terminating in a further step-down recess forming a shoulder, a sealing ring located on said shoulder of the body when engaged in the step-down recess, said crystal bearing against the sealing ring and compressing the sealing in said step-down recess, the space between said inclined facing surfaces being smaller than the corresponding dimension of said crystal to fit into said space, said inclined facing surfaces being spread apart to receive said crystal and said inclined facing surfaces of said resilient opposite side walls bearing against said crystal maintaining said crystal in place to bear downwardly on said sealing ring and on said seating surface.

2. A watch case according to claim 1 wherein the facing surfaces of the side walls of the recess and the edge of the crystal are curved.

3. A watch case according to claim 1, wherein the inclination of the side walls of the recess and of the edge of the crystal relative to the axis of the case is approximately between 4 and 10 degrees.

4. A watch case according to claim 3, wherein said inclination angle is approximately between 5 and 8.5 degrees.

* * * * *